US005569869A

United States Patent [19]

Sone

[11] Patent Number: 5,569,869

[45] Date of Patent: Oct. 29, 1996

[54] KARAOKE APPARATUS CONNECTABLE TO EXTERNAL MIDI APPARATUS WITH DATA MERGE

[75] Inventor: Takurou Sone, Hamamatsu, Japan

[73] Assignee: Yamaha Corporation, Hamamatsu, Japan

[21] Appl. No.: 230,336

[22] Filed: Apr. 20, 1994

[30] Foreign Application Priority Data

Apr. 23, 1993 [JP] Japan ..... 5-120708

[51] Int. Cl.[6] ..... G10H 1/00; G10H 1/36

[52] U.S. Cl. ..... 84/609; 84/610; 84/645

[58] Field of Search ..... 84/601, 602, 609–614, 84/625, 634–638, 645

[56] References Cited

U.S. PATENT DOCUMENTS 5,194,682 3/1993 Okamura et al. ..... 84/625

5,235,124 8/1993 Okamura et al. ..... 84/645 X 5,243,123 9/1993 Chaya ..... 84/625 X 5,250,745 10/1993 Tsumura ..... 84/609 X 5,252,775 10/1993 Urano ..... 84/645

*Primary Examiner*—Stanley J. Witkowski

*Attorney, Agent, or Firm*—Loeb & Loeb LLP

[57] ABSTRACT

A karaoke apparatus responds to a request command for sounding a karaoke performance and is connectable to an external electronic musical apparatus for mixing an additional performance. A data supply is responsive to a request command for supplying an internal data representative of the karaoke performance. A data interface is connectable to an external electronic musical apparatus for admitting therefrom an external data representative of the additional performance. A merging controller merges the internal and external data with each other to avoid clashing therebetween. A sound source has a common tone generator for processing the merged internal and external data to concurrently sound the karaoke performance and the additional performance mixed with each other.

13 Claims, 6 Drawing Sheets

KARAOKE APPARATUS CONNECTABLE TO EXTERNAL MIDI APPARATUS WITH DATA MERGE

BACKGROUND OF THE INVENTION

The present invention relates to a karaoke apparatus responsive to a request command for a karaoke performance and connectable to an external electronic musical apparatus such as a MIDI instrument for merging an additional performance containing percussive tones, effect tones and else.

The karaoke apparatus is constructed such as to produce an instrumental accompaniment part of a requested song, which is concurrently mixed with a live vocal part of the same song picked up by a microphone. The karaoke apparatus is popular, and is installed not only in a bar and a club, but also in a specialized rental room called "karaoke box" and a vehicle such as a tourist bus. The conventional karaoke apparatus is normally a playback type or a musical tone reproduction type composed of a record unit for recording analog or digital audio information and associated video information of karaoke songs, an audio unit for reproducing the karaoke song and mixing a singing voice therewith, a video unit for displaying background pictures and lyric word characters along with the reproduction of the karaoke song, and a control unit for controlling these of the record, audio and video units. Recently, another karaoke apparatus of a synthetic type or a musical tone generating type is developed, which contains a tone generator for synthesizing musical tones according to a song data prescriptive of the karaoke song. Generally, the synthetic karaoke apparatus is connected through a communication network to a host station for retrieving therefrom the song data.

The playback karaoke apparatus has the record unit which is a closed or isolated data source, hence the playback karaoke apparatus cannot respond to a request for a karaoke song which is not stored in the local record unit. On the other hand, the synthetic karaoke apparatus can access a database of the host station to freely retrieve therefrom a desired song data in response to a singer's request. An ultimate type of the synthetic karaoke apparatus is solely dependent on the data telecommunication such that all the requested song data are supplied from the host station without exception. In order to save data communication cost and time required for repeated access to the host station upon every request, a semi-self-support type of the synthetic karaoke apparatus has a storage defining an open data source for stocking the song data supplied from the host station for re-use.

Basically, the karaoke apparatus is constructed to sound a karaoke performance containing an orchestral accompaniment from a loudspeaker while displaying song words concurrently with progression of the karaoke performance. Further, the karaoke apparatus is sophisticated to carry out control of peripheral equipments such as an illumination light and a performance stage in matching with mood of the karaoke performance.

Moreover, a new type of the karaoke apparatus is proposed where the synthetic karaoke apparatus is adopted to connect with an external electronic musical apparatus. This type is not the prior art, but is currently being developed. The karaoke apparatus is constructed to couple with an external electronic musical apparatus through a MIDI interface for a joint live play with the vocal performance of the singer, or a sole live play with the automatic karaoke accompaniment sounded from the karaoke apparatus. In such a case, the karaoke apparatus sounds a mixture of the karaoke performance and the additional performance from a common built-in loudspeaker. For this purpose, the karaoke apparatus of the synthetic type may have a main tone generator for processing the internal song data to synthesize the karaoke performance and a separate tone generator for processing an external MIDI data fed from the coupled external electronic musical apparatus to concurrently synthesize the additional performance. However, addition of the separate tone generator may disadvantageously raise a total production cost of the karaoke apparatus.

SUMMARY OF THE INVENTION

In view of the above noted drawbacks, an object of the present invention is to synthesize additional musical tones of an external electronic musical apparatus by means of a sole tone generator built in the karaoke apparatus.

According to the invention, a karaoke apparatus responsive to a request command for sounding a karaoke performance comprises supply means responsive to a request command for supplying an internal data representative of the karaoke performance, interface means connectable to an external electronic musical apparatus for admitting therefrom an external data representative of an additional performance, merging means for merging the internal and external data with each other to avoid clashing therebetween, and sound means including a common tone generator for processing the merged internal and external data to concurrently sound the karaoke performance and the additional performance merged with each other.

In a specific form, the supply means supplies an internal data having a MIDI format, and the interface means admits external data having the same MIDI format. The common tone generator has a plurality of MIDI channels for generating various musical tones. According to the invention, a part of the MIDI channels are assigned to the external data to synthesize instrumental tones or effect tones originating from the external instrument. In such a case, the internal and external data of the same MIDI format are merged with each other to avoid data clashing therebetween, because the external MIDI data is admitted asynchronously with the internal MIDI data.

DETAILED DESCRIPTION OF THE INVENTION

Figure 1:
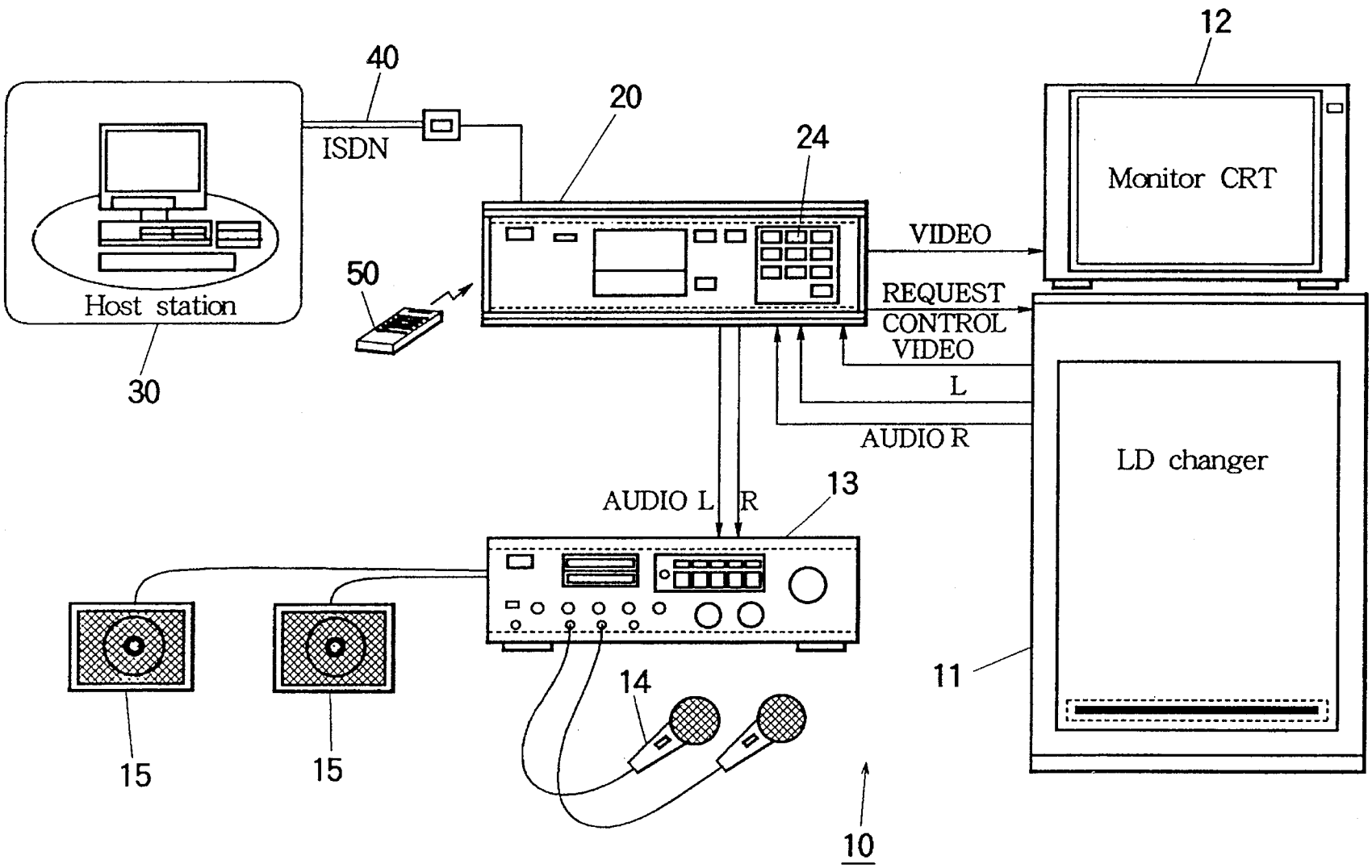
FIG. 1 is an overall block diagram showing an inventive karaoke system.

Hereinafter, embodiments of the invention will be described in conjunction with the drawings. FIG. 1 shows an overall construction of a karaoke system according to the present invention. The system includes a Laser Disc (LD) changer 11, a display in the form of a monitor CRT 12, a mixing amplifier 13, a microphone 14, and a pair of loudspeakers 15, those of which are connected altogether to constitute an ordinary karaoke apparatus 10 of the musical tone reproducing type or the playback type. The inventive system further includes a total control device 20 which contains a tone generating processor and which is connected to those of the monitor CRT 12 and the mixing amplifier 13 to functionally constitute another karaoke apparatus of the musical tone generating type or the synthetic type. This total control device 20 functions as a total system commander connected to a part of the playback type karaoke apparatus 10 so as to build and control the karaoke system which is an integration of the playback karaoke and the synthetic karaoke. A remote host station 30 is connected to the total control device 20 through a fast digital communication network such as Integrated Services Digital Network (ISDN) to transmit thereto a requested song data. A remote controller 50 is provided to input a command such as a song request into the karaoke system.

The playback karaoke apparatus 10 is a self-supporting type such that the LD changer 11 contains a great number of Laser Discs (LDs) as a closed data source. The Laser Disc records a number of karaoke songs and associated words and background pictures. The LD changer 11 is controlled by the request command to access and select the Laser Discs to output an audio signal AUDIO representative of the requested karaoke song to the mixing amplifier 13 as well as to output a video signal VIDEO representative of the associated words and pictures. The mixing amplifier 13 mixes a live voice of a singer picked up by the microphone 14, with a karaoke accompaniment of the requested song. The loudspeaker 15 acoustically transmits the mixed sound of the voice and the accompaniment. Concurrently, the monitor CRT 12 displays the song words and the background pictures associated to the requested karaoke song to assist in the vocal performance of the singer.

Figure 2:
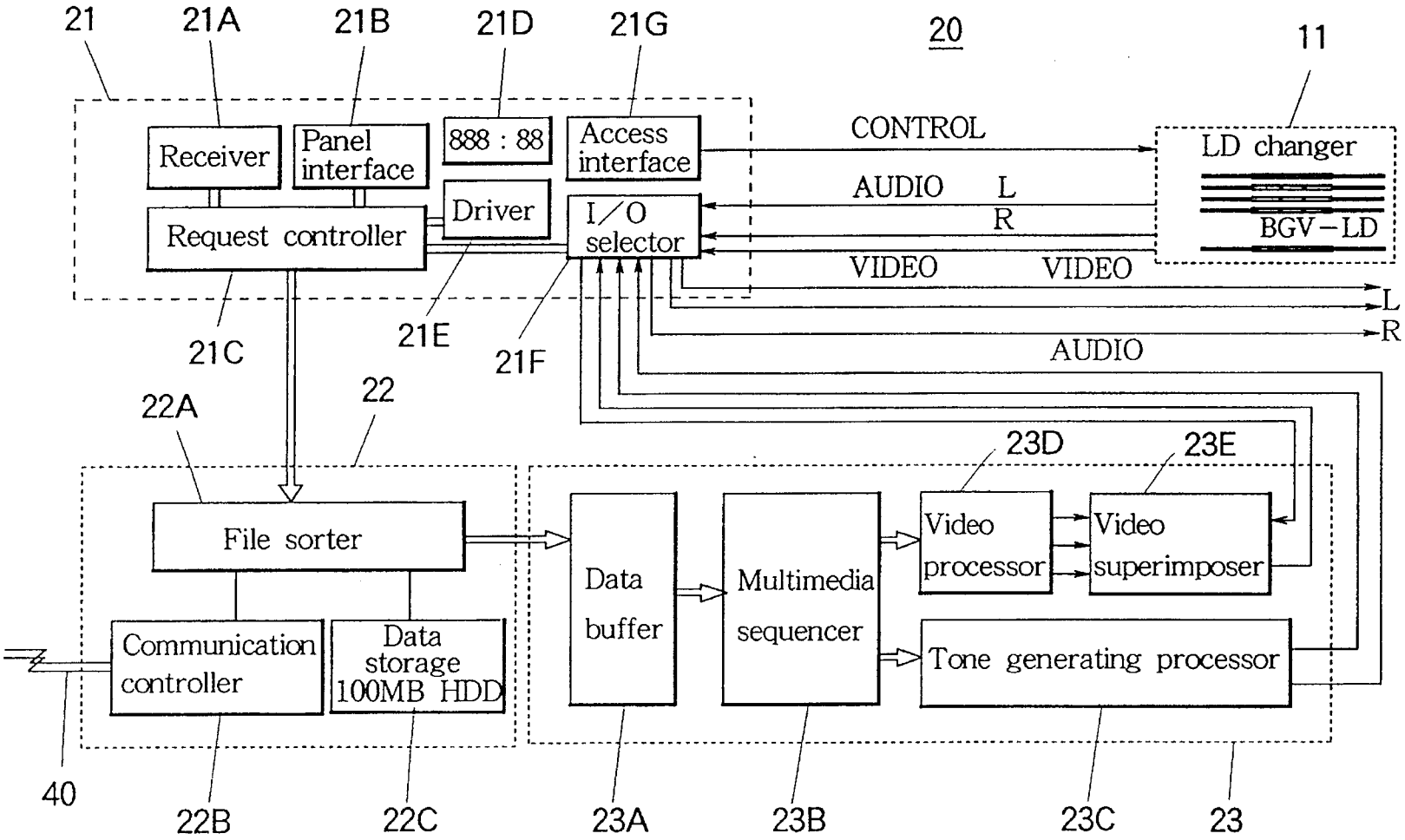
FIG. 2 is a block diagram of a total control device incorporated in the inventive karaoke system.

FIG. 2 is a block diagram showing a detailed internal construction of the total control device 20. The total control device 20 is generally divided into a command block 21 for integrally controlling the playback and synthetic karaoke apparatuses, a data file block 22 for stocking song data used in the synthetic karaoke, and an acoustic/graphic block 23 having various functions. First, the command block 21 is comprised of a receiver 21A, a panel interface 21B, a request controller 21C, an indicator 21D, a driver 21E, an I/O selector 21F and an access interface 21G. The receiver 21A receives a command from the remote controller 50. The panel interface 21B admits another command inputted from a switch panel 24 (FIG. 1) installed in the front face of the total control device 20. The request controller 21C operates in response to a command of song request from either of the receiver 21A and the panel interface 21B so as to organize a plurality of song requests to effect selection and/or reservation of the requested karaoke songs. The indicator 21D is driven by the driver 21E to indicate item codes of the selected or reserved songs. The I/O selector 21F selects inputs and outputs of the audio and video signals.

The data file block 22 is comprised of a file sorter 22A, a communication controller 22B and a data storage 22C. The file sorter 22A receives the selected or reserved item codes of the karaoke songs from the request controller 21C. The communication controller 22B communicates to the host station 30 through the ISDN network 40. The data storage 22C stocks the song data received from the host station through the ISDN network 40 to form a data file as an open data source. In operation, when the file sorter 22A receives the select or reserve command from the request controller 21C, the file sorter 22A initially accesses the data storage 22C to search if the song data of the requested karaoke song is stored. If stored, the searched song data is read out. On the other hand, if not stored, the communication controller 22B is activated to admit a requested song data from a database of the host station 30. The data storage 22C is comprised of, for example, a hard disc driver (HDD) having a capacity of 100 MB (megabyte) such that the HDD can stock one thousand songs provided that each karaoke song is prescribed by 10 KB (kilobyte) of song data in average.

The acoustic/graphic block 23 is comprised of a data buffer 23A, a multimedia sequencer 23B, a tone generating processor 23C, a video processor 23D and a video superimposer 23E. The data buffer 23A temporarily holds the song data supplied from the file sorter 22A. The multimedia sequencer 23B synchronously controls various events including musical tones, pictures and additional effects according to event information contained in the song data. The tone generating processor 23C processes the song data to synthesize the musical tone of the karaoke song under the control by the sequencer 23B. The video processor 23D generates the background picture, the characters of the song words and else. The video superimposer 23E superimposes the graphic outputs of the video processor 23D with another picture such as a background motion picture which is recorded in a background video LD (BGV-LD) loaded in the LD changer 11.

The I/O selector 21F of the command block 21 coordinates the audio part of the karaoke performance such as to select either of the playback audio output from the LD changer 11 and the synthesized audio output from the tone generating processor 23C to feed the mixing amplifier 13. Further, the I/O selector 21F coordinates the video part of the karaoke performance such as to select either of the video output reproduced from the LD changer 11 and the other video output generated from the video superimposer 23E to feed the monitor CRT 12.

Figure 3:
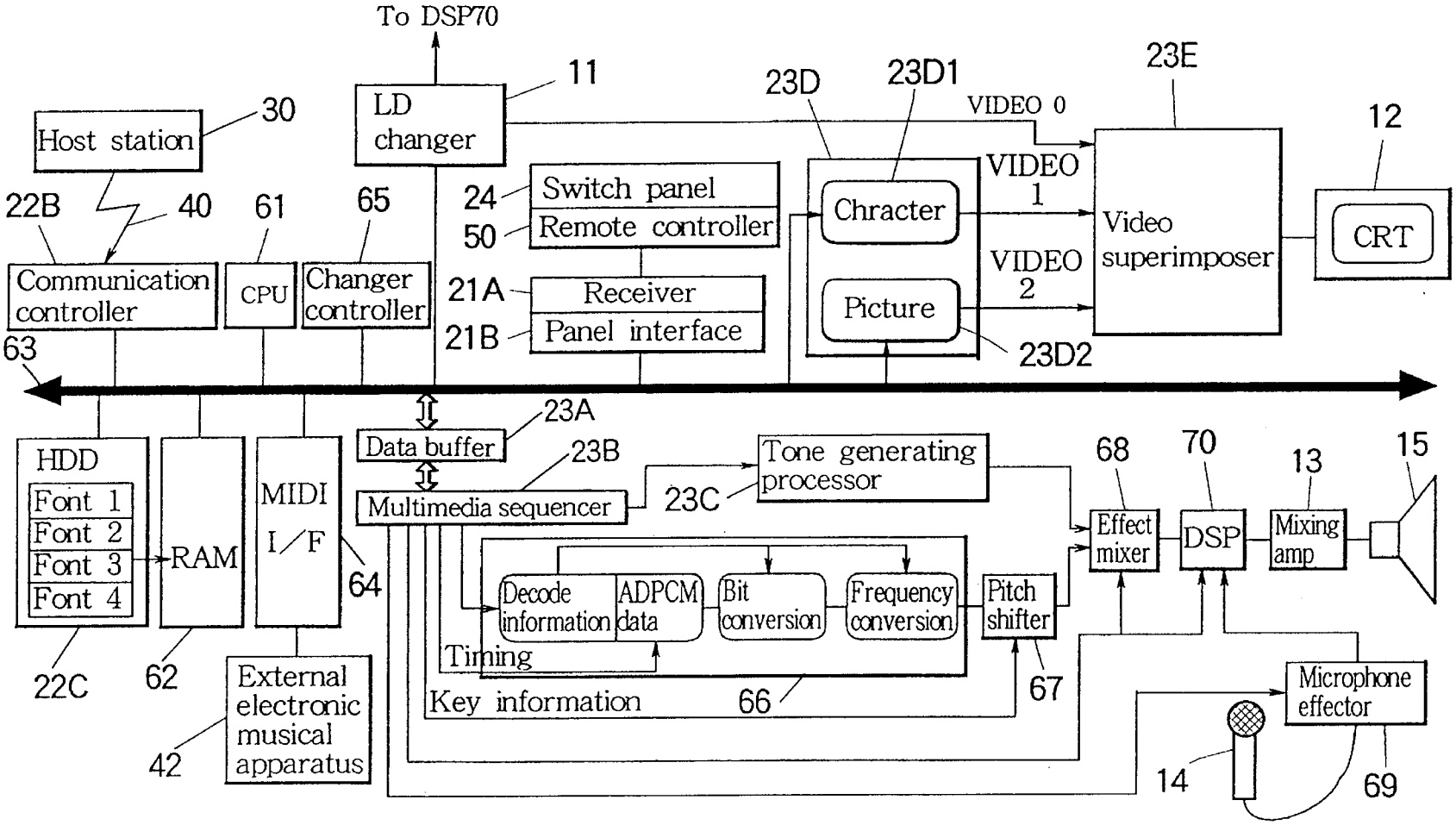
FIG. 3 is a detailed structural diagram of the FIG. 1 karaoke system.

FIG. 3 shows a detailed construction of the inventive karaoke system. The disclosed embodiment contains additional components not explicitly illustrated in FIGS. 1 and 2. For example, a central processing unit (CPU) 61 is provided to undertake overall control of the karaoke system such as merge control of internal and external data according to a program ROM installed in the multimedia sequencer 23B. A random access memory (RAM) 62 provides a working area used when the CPU 61 undertakes the overall control of the karaoke system. A data and address bus line 63 connects the various components altogether to constitute the karaoke system. A MIDI interface 64 is provided to connect to an external electronic musical apparatus 42 for joint live play. A changer controller 65 controls the LD changer 11. The changer controller 65 can be selected according to a model type of the LD changer 11.

An ADPCM decoder 66 is provided to undertake bit-conversion and frequency-conversion to expand an adaptive delta pulse code modulation (ADPCM) data containing compacted audio signals fed from the multimedia sequencer 23B. A pitch shifter 67 is connected to the ADPCM decoder 66 for controlling the tone pitch of the decoded audio signal according to key information provided from the multimedia sequencer 23B. An effect mixer 68 receives the outputs of the pitch shifter 67 and the tone generating processor 23C. The tone generating processor 23C functions as a sole music synthesizer driven by merged internal and external song data to synthesize an audio signal for the karaoke performance.

The tone generating processor 23C is comprised of a tone generating unit for synthesizing the musical tone based on a MIDI data or else and a controlling unit. A microphone effector 69 imparts a sound effect such as an echo, an excitement and else to an output of the microphone 14. A digital sound field processor (DSP) 70 is provided to impart a sound field effect to the output of the microphone effector 69 and the audio output of the LD changer 11.

On the other hand, the video processor 23D processes character information representative of words and else associated to the performed song, and background picture information representative of still and motion pictures so as to generate a video signal for display. In this embodiment, the video processor 23D is divided into two units 23D1 and 23D2. The one video processor unit 23D1 generates the song word characters to output a video signal VIDEO 1, and the other video processor unit 23D2 generates the background pictures to output the video signal VIDEO 2. The LD changer 11 is operated to reproduce the karaoke song recorded in the Laser Disc in the playback karaoke mode, or otherwise to reproduce image information alone for use in the synthetic karaoke mode. More particularly in the synthetic karaoke mode, the LD changer 11 is operated in synchronization with the karaoke accompaniment synthesized by the tone generating processor 23C to output a video signal VIDEO 0 representative of a still picture recorded in a given frame of a given Laser Disc, or representative of a motion picture which starts from a given frame. The video superimposer 23E superimposes these video signals VIDEO 0, VIDEO 1 and VIDEO 2 with each other to form a composite picture.

Hereinafter, detailed description will be given to significant aspects of the operation of the inventive karaoke system in conjunction with the drawings.

Playback/Synthesis Control

When the remote controller 50 or the switch panel 24 is actuated to designate a karaoke song to be performed, the CPU 61 refers to an index table stored in the data storage 22C to check as to if the designated song is recorded in the LDs of the auto-changer 11 which is given the first priority. If recorded, the designated song is reproduced from the LD in the playback mode. The auto-changer 11 outputs the audio signal which is transmitted to the loudspeaker 15 through the DSP 70, and concurrently outputs the video signal VIDEO 0 which is transmitted to the monitor CRT 12 through a selector section of the video superimposer 23E. On the other hand, the live voice of the singer is converted by the microphone 14 into an electric signal which is fed to the DSP 70 through the microphone effector 64. The mixing amplifier 13 mixes the accompaniment part and the vocal part with each other so that the loudspeaker 15 produces the mixed audio output.

If the designated song is not recorded in the LD changer 11, the CPU 61 searches the song data stocked in the HDD storage 22C which is given the second priority. If the designated song is stocked in the data storage 22C, the song data is retrieved and loaded into the RAM 62. The tone generating processor 23C operates according to the song data to synthesize the musical tones to effect the karaoke performance. Such a synthesis of the musical tone is carried out under the control by the multimedia sequencer 23B. With regard to the audio part, the tone generating processor 23C successively generates the musical tone signal according to the digital song data read out from the RAM 62. The musical tone signal is acoustically reproduced by the loudspeaker 15 through the effect mixer 68, the DSP 70 and the mixing amplifier 13. With regard to the video part, the video processor units 23D1 and 23D2 produce the word characters and the background pictures, respectively, according to graphic information contained in the song data under the control by the multimedia sequencer 23B in synchronization with progression of the song. The generated word characters and background pictures are visually displayed by the monitor CRT 12 through the video superimposer 23E. Additionally, another background picture reproduced from the LD changer 11 may be also superposed to the background picture and the word characters by the video superimposer 23E. The word characters are variably displayed by the monitor CRT 12 such that a color of the displayed words is sequentially changed in synchronization with progression of the song so as to teach the player vocal timings. Accordingly, the player can sing a song while handling the microphone 14 and following the word characters displayed on the monitor CRT 12.

If the designated song data is not stocked in the HDD storage 22C, the CPU 61 activates the communication controller 22B to take the designated song data from the host station 30 in an online mode, which is given the third priority. Namely, the host station 30 is called through the ISDN network 40. When the host station 30 responds to the calling, the song item code is sent to request the designated song data. The taken song data is stocked in the HDD storage 22C for re-use.

Song Data Format

Figure 4:
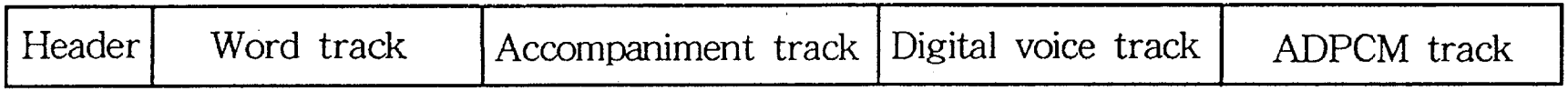
FIG. 4 is a schematic diagram showing a song data format adopted in the inventive karaoke system.

The synthetic karaoke apparatus is driven by the song data which has a data format generally shown in FIG. 4. The song data is comprised of a header and a subsequent serial train of a word track, an accompaniment track, a digital voice track, ADPCM track and so on. Each track has a similar alternate arrangement of a duration and an event. The song data is transferred from the host station in the serial format so that the transfer of the song data is completed when the last track is received. For example, the typical song data has a length of 15 KB–20 KB for the header and 100 KB from the word track to the voice track. Such a length of the song data is transferred by about 15 seconds through the fast ISDN network having a data transfer rate of 8 KB per second. Actually, this net transfer time is added by overheads such as a calling time of the host station, a database access time in the host station and else so that the total transfer time reaches more or less 20 seconds.

Multimedia Sequencer

The multimedia sequencer 23B is basically composed of an MIDI sequencer and is provided with operating system (OS) function to concurrently execute parallel tasks. Consequently, the multimedia sequencer 23B can execute in real time basis a multiple of events of plural tracks contained in one song data in synchronization with each other under the software control. The "event" covers a wide variety of representations involved in the karaoke performance, including instrumental accompaniment, song word display, background picture, sound effect, external instrument control and so on. The multimedia sequencer 23B receives the song data which is read out from the working RAM 62 by means of the CPU 61. As shown in FIG. 4, the song data is composed of the word track, the accompaniment track in the form of an MIDI track, the voice track, and the additional ADPCM track. The multimedia sequencer 23B distributes the MIDI data to the tone generating processor 23C to synthesize the karaoke accompaniment. Further, the sequencer 23B feeds the ADPCM data to the ADPCM decoder 66 where the compacted ADPCM data is expanded and decoded. Moreover, the sequencer 23B controls the ADPCM decoder 66 according to event information contained in the voice track so as to regulate decoding of the ADPCM data.

Figure 5:
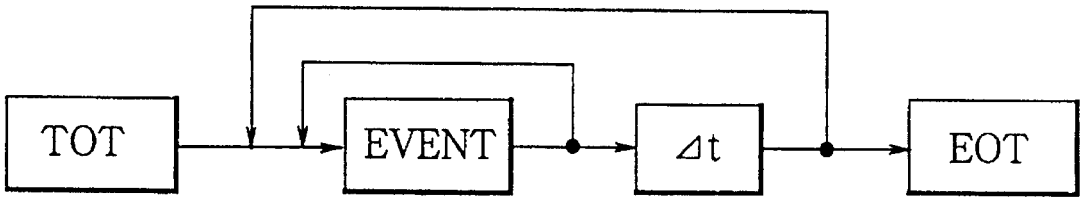
FIG. 5 is an illustrative diagram showing a routine of executing MIDI events.

Referring to FIG. 5, the regular MIDI track is comprised of an alternate arrangement of an event and a duration (waiting interval) Δt, which starts from the top of track (TOT) and terminates by the end of track (EOT). The sequencer 23B sequentially processes each event in repetitive manner as indicated by the arrows of FIG. 5.

Figure 6:
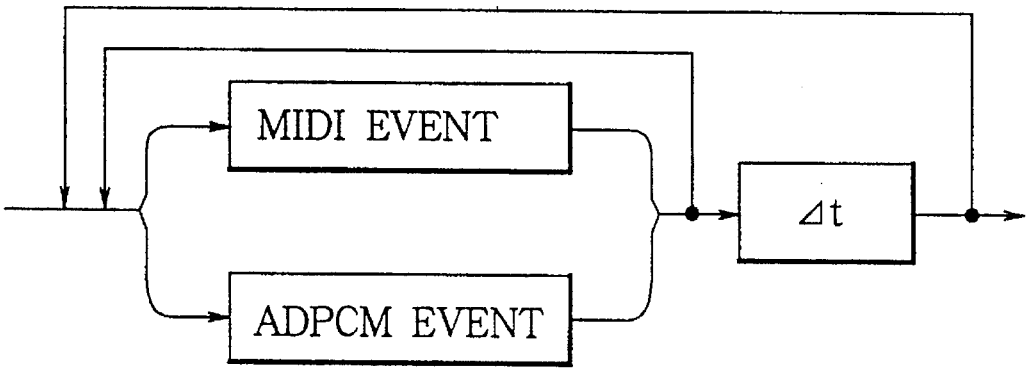
FIG. 6 is an illustrative diagram showing a routine of executing ADPCM events concurrently with the MIDI events.

On the other hand, in case that the song data is added with the ADPCM data shown in FIG. 4, the ADPCM event is executed in parallel to execution of the MIDI event as illustrated by FIG. 6. The ADPCM event is prescribed, for example, in the digital voice track, hence the timing of executing the ADPCM event can be synchronized with the MIDI event which is prescribed in the accompaniment track under the software control. Each ADPCM event contains various items such as (1) designation of ADPCM tone, (2) inactive status of pitch shift, (3) tone volume, and (4) pitch shift amount.

On the other hand, the ADPCM data typically represents musical tone waveforms such as a back chorus voice waveform involved in the karaoke performance. Although compacted, the ADPCM data has a data volume far greater than that of the MIDI data. However, as long as the back chorus is concerned, a certain chorus part may be repeatedly added in the same song while simply being modulated. In view of this, common chorus parts are provisionally prepared as an independent set of the ADPCM data. During the course of reproduction, the provisionally prepared ADPCM data is selected to synthesize the back chorus involved in the reproduced song. Such a technique can save the total volume of data transferred from the host station and can reduce the memory capacity. The "designation of ADPCM tone" involved in the ADPCM event is utilized to select desired one of the ADPCM waveforms.

The ADPCM data may be reproduced in a pitch-shifted form. For this purpose, the "pitch shift amount" is involved in the ADPCM event so as to designate a desired degree of the pitch shift. The pitch shifter 67 shown in FIG. 3 carries out the pitch shift of the ADPCM tone. The pitch shifter 67 may be composed of a digital signal processor called "karaoke processor (KP)". The pitch shifter 67 can conduct not only modulation in which the song is temporarily pitch-shifted, but also transposition in which the song is entirely transposed by the user's command. In such a case, the pitch shift may be superposed further to the transposed form of the song.

The ADPCM data may be used to represent a waveform of effect tones besides the back chorus tones. In such a case, the "inactive status of pitch shift" involved in the ADPCM event is set to avoid unnatural pitch shift of the certain effect tone. The inactive status is effective to inhibit the pitch shift of the ADPCM tone even if the user commands the transposition. Lastly, the "tone volume" is set to automatically control the volume of the ADPCM tone each event.

Connection to External MIDI Instrument

As shown in FIG. 3, the present karaoke system is provided with the MIDI interface 64 for connection to the external electronic musical apparatus 42 such as a percussion instrument to receive therefrom an external MIDI data representative of a percussive tone or other additional effect tones. The CPU 61 retrieves the external MIDI data from the MIDI interface 64, and feeds the same to the sequencer 23B. The sequencer 23B controls the tone generating processor 23C to assign one channel to the external electronic musical apparatus 42 so as to produce an additional performance containing the percussive tone or else without using a separate tone generator for the external electronic musical apparatus. For this, the internal MIDI data is provisionally arranged such that one of all the channels (for example, 16 channels in a single system, or 32 channels in a double system) is reserved in the tone generating processor 23C for the external MIDI data. Alternatively, the CPU 61 selectively distributes the external MIDI data received from the interface 64 to a currently vacant one of the MIDI channels, which is not working for processing of the internal MIDI data. Namely, the channels of the common tone generator is shared by the internal and the external MIDI data. The external electronic musical apparatus may include various models such as a player piano, which can provide MIDI output.

Merge of Internal and External MIDI Data

Generally, the MIDI data starts from a status byte followed by data bytes to form an 8 bit data stream. In the present embodiment, the external MIDI data enters through the interface 64 asynchronously with the internal MIDI data read out from the RAM 62 for the karaoke performance. Thus, a clash of the asynchronous data would cause data destruction. In order to avoid this, merge is conducted to avoid the clash between the internal and external MIDI data. When the external MIDI data enters from the separate electronic musical apparatus while the internal MIDI data circulates in the karaoke system, the transfer of the external MIDI data is delayed until the last data byte of the internal MIDI data packet passes.

Figure 7:
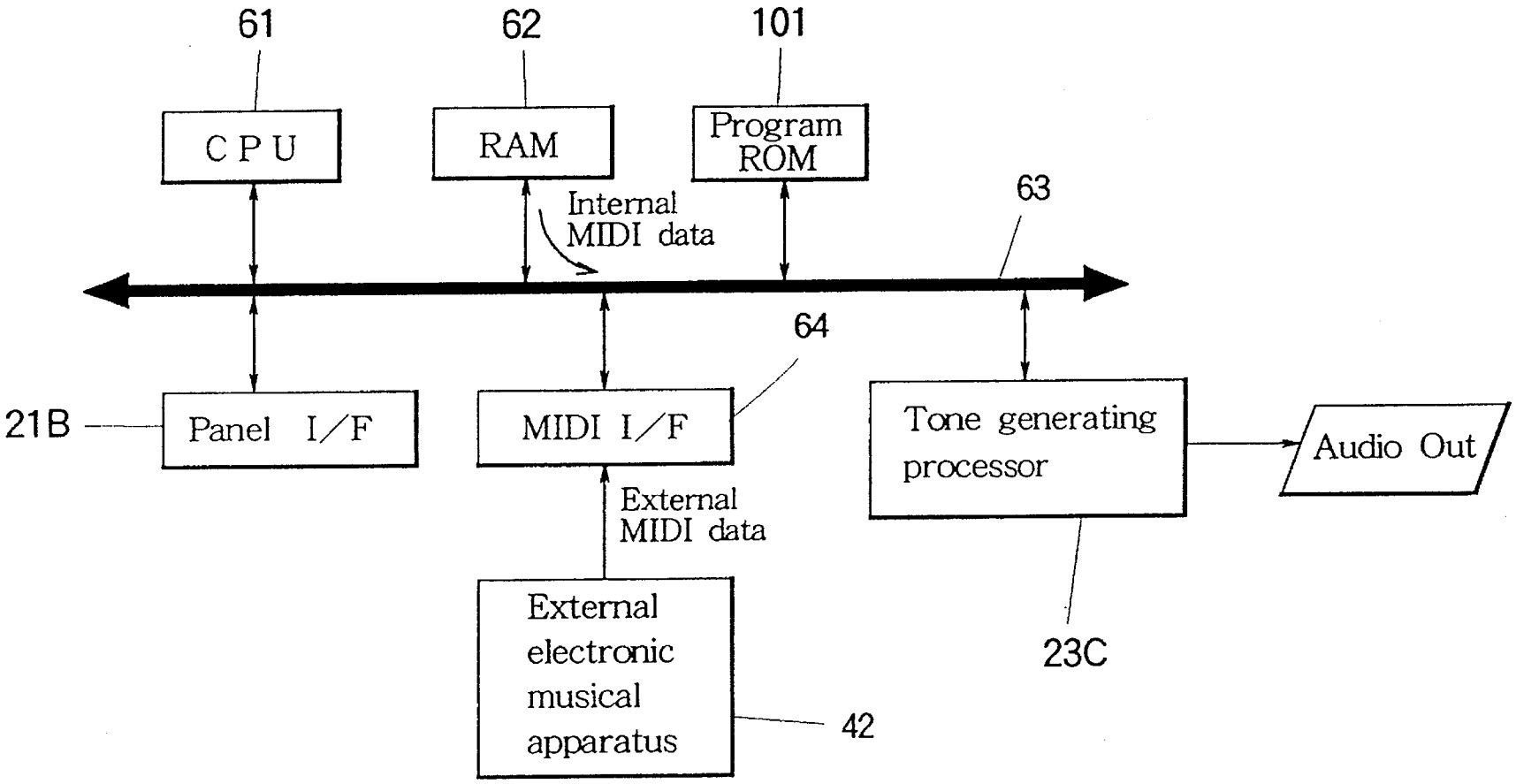
FIG. 7 is a system diagram showing a data merge control installation.

FIG. 7 shows a simplified karaoke apparatus having a sole tone generating processor 23C and an MIDI interface 64 connectable to an external electronic musical apparatus 42. The internal MIDI data for the karaoke performance is retrieved from a RAM 62 by means of a CPU 61, and is fed to the tone generating processor 23C through a data bus line 63. On the other hand, the external MIDI data for the additional performance flows into the data bus line 63 from the external electronic musical apparatus 42 through the MIDI interface 64. In this case, the CPU 61 operates according to a control program stored in a ROM 101 to carry out merging of the internal and external MIDI data to avoid clash therebetween.

Minus-One Playing

In one modification, the accompaniment track of the song data may record various timbres in terms of instrument names, which are fixedly assigned to respective channels of the tone generating processor. For example, the piano sound is assigned to the first channel, the guitar sound is assigned to the second channel and so on. When an external MIDI instrument is connected to the karaoke system and a particular timbre is specified by means of a panel interface 21B, the internal MIDI data of the same timbre is selectively blocked to silence a corresponding part of the karaoke accompaniment. By such a manner, the player of the external MIDI instrument can manually perform the silenced part in a manner so-called "minus-one play."

What is claimed is:

1. A karaoke apparatus responsive to a request command for sounding a karaoke performance and being connectable to an external electronic musical instrument, the karaoke apparatus comprising:

supply means responsive to the request command for supplying internal data representative of the karaoke performance;

interface means connectable to the external electronic musical apparatus for receiving external data representative of an additional performance from the external electronic musical apparatus;

merging means for merging the internal and external data with each other to avoid clashing therebetween; and sound means including a common tone generator for processing the merged internal and external data to concurrently sound the karaoke performance and the additional performance that were merged with each other.

2. A karaoke apparatus according to claim 1, wherein the supply means comprises means for supplying internal data having a MIDI format, and the interface means comprises means for receiving external data having the same MIDI format.

3. A karaoke apparatus according to claim 1, wherein the interface means is connectable to an external electronic musical apparatus which is manually playable to merge a live additional performance during the course of the karaoke performance.

4. A karaoke apparatus according to claim 1, wherein the common tone generator has a plurality of channels to generate various musical tones involved in the karaoke performance and the additional performance, in which at least one of the plurality of channels is reserved for processing of the external data.

5. A karaoke apparatus according to claim 1, wherein the common tone generator has a plurality of channels shared by the internal and external data for generating various musical tones involved in the karaoke performance and the additional performance.

6. A method of merging MIDI data from separate sources to eliminate data clashing, the method comprising the steps of:

receiving internal MIDI data packets from an internal source;

transferring the internal MIDI data to a data bus;

receiving external MIDI data packets from an external source;

monitoring the data bus to ascertain the presence of an internal MIDI data packet on the data bus; and delaying the transfer of external MIDI data to the data bus until the last byte of the internal MIDI data packet passes.

7. A karaoke apparatus responsive to a request command for sounding a karaoke performance and being connectable to an external electronic musical instrument, the karaoke apparatus comprising:

a control device responsive to the request command for supplying internal data representative of the karaoke performance;

an interface connectable to the external electronic musical apparatus for receiving external data representative of an additional performance from the external electronic musical apparatus;

a data controller for merging the internal and external data with each other to avoid clashing therebetween; and an acoustic/graphic processor including a common tone generator for processing the merged internal and external data to concurrently sound the karaoke performance and the additional performance that were merged with each other.

8. A karaoke apparatus according to claim 7, wherein the control device comprises means for supplying internal data having a MIDI format, and the interface comprises means for receiving external data having the same MIDI format.

9. A karaoke apparatus according to claim 7, wherein the interface is connectable to an external electronic musical apparatus which is manually playable to merge a live additional performance during the course of the karaoke performance.

10. A karaoke apparatus according to claim 7, wherein the common tone generator has a plurality of channels to generate various musical tones involved in the karaoke performance and the additional performance, in which at least one of the plurality of channels is reserved for processing of the external data.

11. A karaoke apparatus according to claim 7, wherein the common tone generator has a plurality of channels shared by the internal and external data for generating various musical tones involved in the karaoke performance and the additional performance.

12. A karaoke apparatus according to claim 7, wherein the additional performance data is time delayed to eliminate data clashing with the internal data of the karaoke performance.

13. A karaoke apparatus according to claim 7, wherein the data controller delays the additional performance data until the last byte of the karaoke performance data packet is off the data bus.

* * * * *